United States Patent [19]

Lotto

[11] Patent Number: 4,556,124

[45] Date of Patent: Dec. 3, 1985

[54] MACHINE MADE OF A SET OF EQUIPMENT FOR THE INSPECTION AND THE MAINTENANCE OF THE LOWER SURFACES OF ROAD AND RAILWAY BRIDGES, AS WELL AS VIADUCTS AND THEIR RESPECTIVE PIERS

[76] Inventor: Sergio Lotto, Via Marco Antonio Calza n. 7, Padova, Italy

[21] Appl. No.: 555,087

[22] Filed: Nov. 25, 1983

[30] Foreign Application Priority Data

Nov. 26, 1982 [IT] Italy ..... 41680 A/82

[51] Int. Cl.[4] ..... E04G 1/36

[52] U.S. Cl. ..... 182/63; 182/2

[58] Field of Search ..... 182/63, 2, 62.5, 64–68, 182/141, 142, 145, 148

[56] References Cited

U.S. PATENT DOCUMENTS

| | | | |
|---|---|---|---|
| 3,608,669 | 9/1971 | Lindsay | 182/63 |
| 4,074,790 | 2/1978 | Colbachini | 182/63 |
| 4,088,200 | 5/1978 | Cowley | 182/63 |
| 4,154,318 | 5/1979 | Malleone | 182/63 |

FOREIGN PATENT DOCUMENTS

| | | | |
|---|---|---|---|
| 717215 | 2/1980 | U.S.S.R. | 182/63 |

*Primary Examiner*—Reinaldo P. Machado
*Assistant Examiner*—Alvin Chin-Shue
*Attorney, Agent, or Firm*—Burns, Doane, Swecker & Mathis

[57] ABSTRACT

An arrangement for use in the inspecting and carrying out of maintenance on, for example, the undersurface of bridges and viaducts, including piers thereof, the arrangement being adapted for mounting upon a mobile frame, the arrangement comprising in combination a first elongated member adapted to be rotatably mounted upon the mobile frame; a second elongated member secured to the first member and adapted to extend therefrom; motor means for use in rotating the second member relative to the first member; a third elongated member hingedly secured to the second elongated member adjacent the free end thereof; fifth wheel means associated with the third elongated member for use in rotating the third elongated member relative to the second elongated member; and a fourth elongated member secured to the third elongated member and extendable therefrom so as to lie in spaced parallel relation to the first and second elongated members.

17 Claims, 9 Drawing Figures

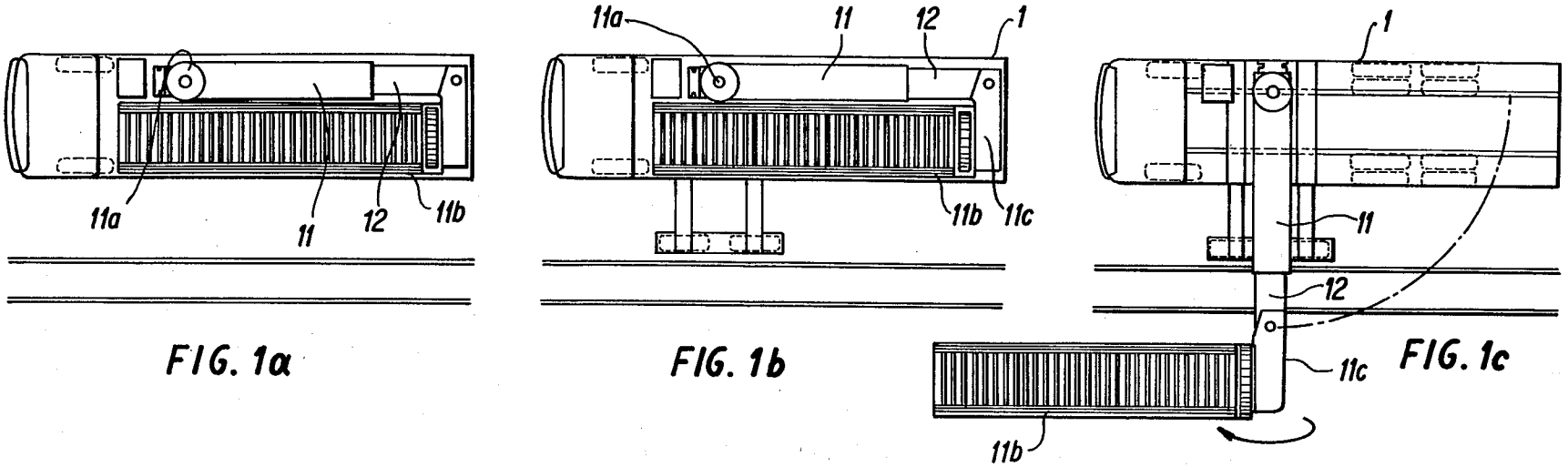
FIG. 1a
FIG. 1b
FIG. 1c
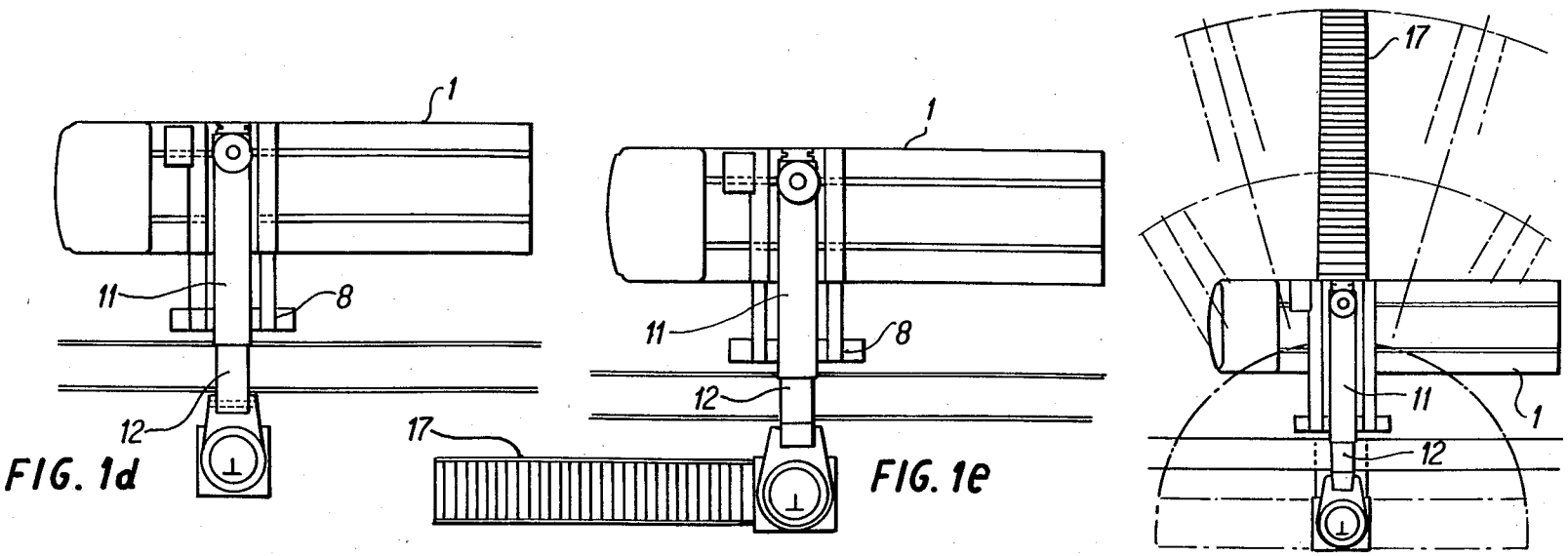
FIG. 1d
FIG. 1e
FIG. 1f

MACHINE MADE OF A SET OF EQUIPMENT FOR THE INSPECTION AND THE MAINTENANCE OF THE LOWER SURFACES OF ROAD AND RAILWAY BRIDGES, AS WELL AS VIADUCTS AND THEIR RESPECTIVE PIERS

BACKGROUND OF THE INVENTION (a) Field of the Invention

The present invention relates to machines and parts comprising the same for use in the inspection and maintenance of bridges and viaducts, including piers thereof, and particularly the underside road surfaces of such bridges and viaducts.

(b) Description of the Prior Art

The difficulties encountered by whose who attend to the inspection and maintenance of road and railway bridges are well known by engineers, especially if they have to do with the lower parts of spans and piers and if the latter are very high or in the middle of rivers and rapids.

Attempts have been made in the past to overcome such difficulties by for example, redesigning construction and moving-type equipment, however, such has not proved satisfactory to resolving the various problems existing.

The prior art machines include moving platforms which can be accommodated on a wagon. Such are used for the test and maintenance of bridges and are derived from excavators or cranes. Although such machines are useful, they suffer the disadvantage of being of heavy weight, which adds considerable weight to the whole machine. Apart from this, they require large assembly and moving time, lack safe stabilizing means, which means also tends to cause road damage and furthermore, they are non-fuel efficient. In addition, the axle loads of many such prior art machines exceed those permitted by, for example, the EEC (European Economic Community) and other bodies. Thus, the use of such machines is highly restricted, i.e., to use on superhighways. They therefore cannot be used on secondary and country roads. A further major drawback of the prior art machines is that they do not provide precision movement and control of the inspection components of the machine.

SUMMARY OF THE INVENTION

It is therefore an important aim of the present invention to provide a new and improved machine, including arrangements which will overcome said various problems. Other important aims of the present invention will become apparent from the text hereinafter.

An important advantage of the machine in accordance with the present invention is that it utilizes a power source for the various components of the machine which is independent of that provided for moving the machine from place to place. Obvious benefits arise.

The present invention results in providing machines which are as much as 40% lighter in weight than those of the prior art. A contributing factor for this is the principle of stabilization employed and which includes a mobile frame or carriage means mounted on pneumatic tyres or alternatively, steel railway-type wheels, strategically placed to absorb all vertical loads, resulting in a lightweight vehicle. The layout of the components on the vehicle are so arranged as to reduce stress passing through the vehicle carriage structure, which has been designed in such manner as to dispense with the need for counterbalancing.

The arrangement according to the present invention, when mounted upon its selected type mobile frame, is deemed to meet the clearance limits of the various highway codes. This is made possible by the present compact design having low bearing centers and no extensive protrusions when in the folded transport mode. The machine in transport mode comprises the vehicle with its equipment thereon secured by suitable anchoring means. The machine, when engaged in bridge inspection, occupies only half the road. This virtually eliminates risk to the personnel carrying out the inspection, which lasts, in most cases, only a few minutes, thanks in part to the use of buttons or the like controlling movement of the components of the arrangement. The various launching or extending of the arrangement components from the vehicle may be accomplished manually or more preferably, by powered means. Following the extending of the components, the technicians may proceed safely to descend the components, gaining access via ladders provided.

As will be deduced, including from the specification hereinafter, the machine, in accordance with the present invention, comprises three fundamental elements. Having reference to the one preferred embodiment disclosed, the three elements are as follows.

The first element is a carriage which comprises four or more wheels, which may be of the pneumatic tyre type or railway steel wheel type. The carriage forms the base for the launching or extending of components of the machine over the edge of the bridge or viaduct that is to be inspected. The carriage includes stabilizing jacks which provide marginal rigid bearings, the purpose of which is to maintain the machine essentially in the horizontal, absorbing the camber of the road upon which the machine rests. The carriage includes oleodynamic engines, provided with brake means which affords very small and smooth jerk-free movements of the components.

The second element comprises a tubular structure, having a rotating tube telescoped therewithin and controlled by jacks which change the movement of towers secured thereto, i.e., from horizontal to vertical plane when the machine is in operative mode. This secures stabilization of the components during the inspection, i.e., in ascent or descent, so that, among other things, the technicians in a platform extended from the towers, do not suffer the camber of the road.

The third element comprises the towers, including platforms therein. One of the towers is telescoped within the other and relative movement of the towers is provided via a long stroke jack cylinder. The telescoping towers include an open side and are adapted to slide one over the other on link-blocks. The main tower which receives telescopingly the other tower is mounted via a fifth wheel which allows it to rotate, accordingly permitting rotation within fixed limits of the said platforms, during the inspection mode. This rotary movement is provided via oleodynamic engine means. As indicated above, the towers include platforms and such are located within the towers, the platforms being adapted to slide horizontally, such movement being effected through a roller chain driven by an oleodynamic engine.

There is also provided a ladder mounted shuttle adapted to accommodate one or two persons. The shuttle is controlled via a pair of oleodynamic or compressed air jacks. As will be realized, with this additional shuttle device, closer inspections can be facilitated.

More precisely, the fundamental characteristics as regards innovation, that those skilled in the art to which the present invention is directed, notices in the present machine, are the following.

The complete control provided, even as regards the micrometric adjustment of the ladder or more particularly the inspection shuttle, which allows a perfect inspection to be made, controlled in every sense by the technicians. This feature has never been present on equipment of the present type until now. This control is made possible by chemical energy, derived from batteries which provide the feeding to the oleodynamic electropumps. Regarding energy saving, the advance is evident even by observing the moderate consumption of energy of the accumulators, used only during the single movements of inspection, as compared with the great waste of fuel of the machine which has to work during the whole inspection operation.

The weight, which is considerably less, in comparison with the sets of equipment available until now is due in part to the new statics-geometry, which completely eliminates the need for counterbalance. Consequently, the weight of the equipment and its structure is reduced with the advantage that the road surface is not cut up, also that the degree of stability during the launching-component extending maneuvers, which occurs horizontally, is increased. In fact, this horizontal launching, represents one of the absolute innovations of the present equipment, both for the high degree of stability afforded which is constant for all the operations, and the advantages of not exceeding the transport height, accordingly of passing under live wires, which in the case of railway-type, can reach 4,000 volts.

The platforms inside the towers which rotate completely are an innovation which is constituted of the two towers, one fixed and the other sliding, interpenetrating, with complete rotation, and an open side which allows the housing of the two or three horizontal platforms in its inside, hinged to the sliding tower too, and moved, in their descent and spreading by only one oleodynamic long stroke jack piston.

The possibility of inspecting bridges and viaducts provided with "breakwind barriers" thanks to the lifting gear of the joint members of the fifth wheel, which permit the lifting of the whole unit of towers and platforms (and so the bridges and viaducts can be inspected without first removing the above-mentioned barriers).

As regards road clearance and weights and has already been mentioned, the present machine with its respective equipment, is limited in terms of height, length and breadth of the selected vehicle. In consequence, the axle loadings fall within the norm of the European and American countries. As regards the railway clearance and weights on rail, the present machine with its respective equipment is suitable for every railway with unified gauge and weights per axle on rail, and do not exceed the limits fixed by international law.

As for the access of personnel to the platforms, and for the inspection procedures, with the machine's components already launched, the technicians work comfortably, both in terms of the proper ladders and its shuttle, arranged in keeping with the norms of industrial accident research and for the possibility of moving the equipment in a completely autonomous and micrometric way.

In conclusion, there is the advantage that the machine with all its equipment can be transported by road (including without the truck, by sea and by air), fully assembled, and in the case of need, even in containers so that it is ready to be set up on the selected vehicle at place of arrival.

In one aspect of the present invention there is provided a machine comprising a set of equipment for use in the inspection and maintenance of the undersurface of bridges and viaducts and their respective piers, the machine comprising: a wheeled carriage which forms the base for the mounting of the equipment which is adapted to be launched from the carriage over the edge of the bridge-viaduct structure, the equipment including a first elongated boom member rotatably mounted for swinging movement about a generally vertical axis upon the carriage, the equipment also including a second elongated boom member secured to the first elongated boom member and adapted to telescopingly extend therefrom and axially rotate relative thereto, including motor means for use in telescopingly moving and axially rotating the second member relative to the first member, to change the directional movement of towers secured to the second elongated boom member, from the horizontal to the vertical, when the first and second elongated boom members are launched laterally from the carriage in operative position, and wherein during the change of directional movement, the towers do not extend upwardly of the first and second elongated boom members, the carriage including means for stabilizing the carriage when the equipment is extended, said means for stabilizing comprising stabilizing jack means securable in spaced relation to the carriage laterally thereof and engaging the support for the machine and engaging the launched first elongated boom member whereby to support the same, thus to prevent the carriage being subjected to cantilever loads imposed as a result of the launched equipment and eliminate the need for counterbalance weights on the carriage, the machine including oleodynamic motor means equipped with braking means to provide smooth and jerk-free movements of the equipment during operation thereof.

BRIEF DESCRIPTION OF THE DRAWINGS

The invention is illustrated by way of example in the accompanying drawings wherein:

FIGS. 1*a*–1*f* inclusive are plan views of a machine in accordance with the present invention, showing the machine in various modes, including that of transport and operation;

Figure 3:
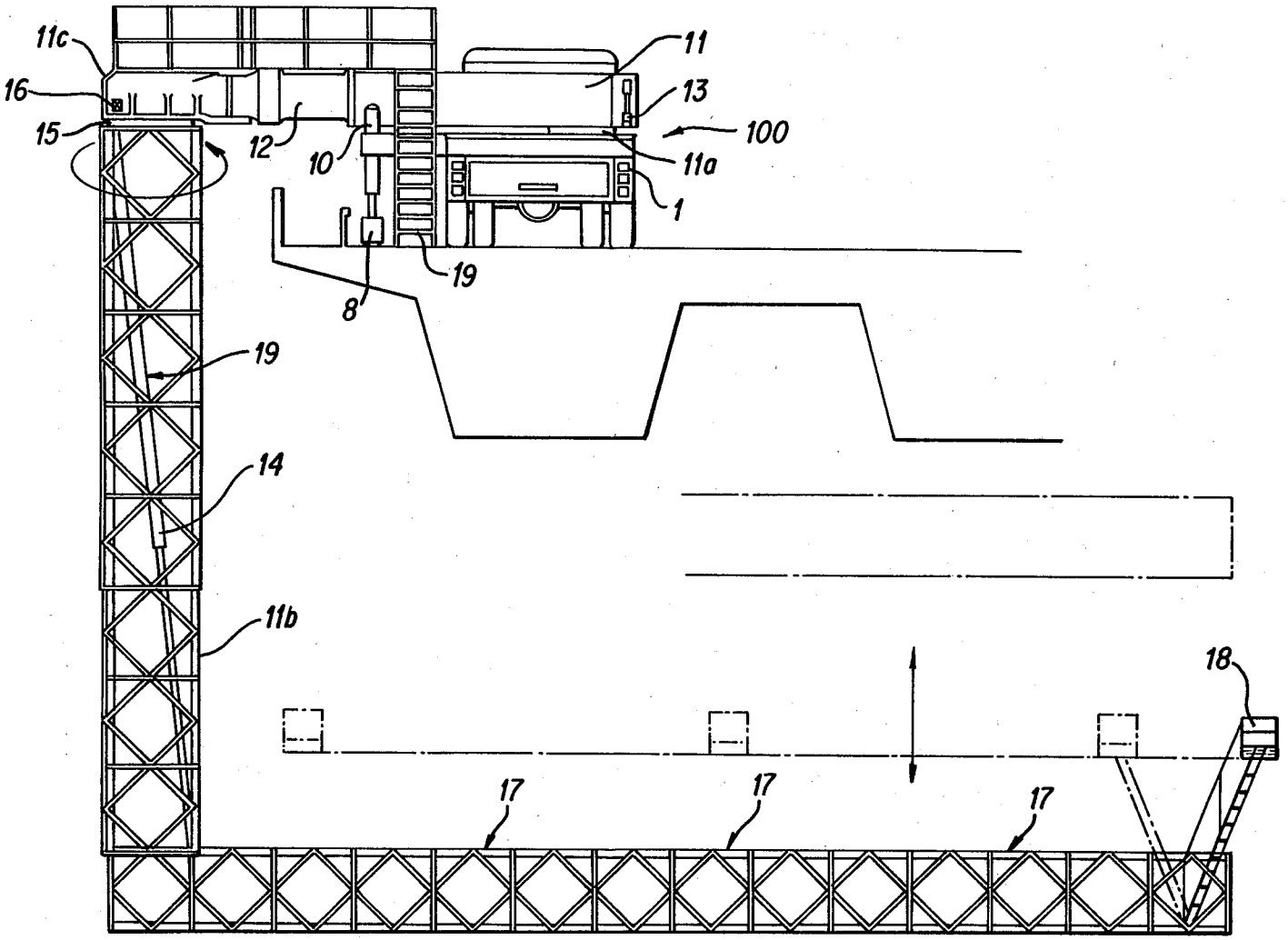
FIG. 3 is a rear elevational view of the machine seen in FIG. 2 with its various parts extended, including under a viaduct, i.e., in operational mode, in readiness for the descent of the technicians to carry out inspection and maintenance.

In the case of a railway bridge, rather than a road bridge or viaduct, seen in FIG. 3, the apparatus arrangement in accordance with the present invention may be mounted on a railway wagon, such as a flat bed or locomotive adapted for such purpose.

DESCRIPTION OF PREFERRED EMBODIMENT

Referring now in detail to the drawings.

FIG. 3 discloses an arrangement 100 for use in the inspecting and carrying out of maintenance on, for example, the underside face of bridges and viaducts, including piers thereof, the arrangement being mounted upon a vehicle 1 and comprising a first elongated member 11 rotatably mounted upon vehicle 1 via a fifth wheel 11*a;* a second elongated member 12 secured to elongated member 11 and adapted to extend therefrom, which in the case of the embodiment shown is by telescoping action. Motor means (not shown) is provided for use in extending member 12 outwardly of member 11. If desired, such may be dispensed with, in which case, member 12 would be extended manually. Motor means 13 in the form of jacks is provided for rotating elongated member 12 respective elongated member 11, accordingly rotating a third elongated member 11*b* which is hingedly secured to elongated member 12 via a hinge arrangement 11*c*. A motor means (not shown) is also provided for use in hinging elongated member 11*b* about elongated member 12, although again, such is optional. Hinge arrangement 11*c* may include a locking means (not shown) for use in securing elongated members 11*b* and 12 relative to one another when in operative or stowed position. A fifth wheel means 15 is provided intermediate hinge arrangement 11*c* and elongated member 11*b* for use in mounting the same. Such fifth wheel arrangement, as in the case of similar arrangement 11*a*, include controlled powered means (not shown) and which again is an optional but preferred feature. A series of sliding platforms 17 comprising a fourth elongated member are secured to and extend from elongated member 11*b* to lie in spaced parallel relation to elongated members 11 and 12.

Arrangement 100 may further include, as shown in FIG. 3, a ladder mounted inspection means 18, such being mounted for controlled pivotal movement about the elongated fourth member comprising platforms 17. Inspection means 18 includes a control means (not shown) for use in controlling movement of elongated members 11, 12, 11*b* and 17 (as well as itself) relative thereto. Inspection means 18 comprises a platform for accommodating at least one or two persons.

Member 11*b*, as seen in FIG. 3, comprises two tower sections, one telescoped within the other and extending therefrom, extension being provided and controlled by long stroke jack 14.

The aforementioned tower sections in the case of the present embodiment disclosed, are adapted to accommodate therewithin, platforms 17. Movement of platforms 17 outwardly of elongated member 11*b* may be effected via roller chain means (not shown) driven through an oleodynamic motor means.

Figure 4:
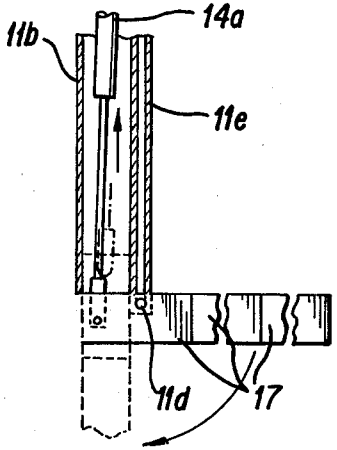
FIG. 4 is a diagrammatic view showing a further embodiment for mounting and controlling a component of the machine in accordance with the present invention.

As an alternative arrangement, platforms 17 may be assembled as seen in FIG. 3 and pivotally arranged to the free end of elongated member 11*b*, as seen in FIG. 4. This permits them to be swung around and positioned for in-line telescopic movement within elongated member 11*b* by, for example, jack means 14*a* being similar to long stroke jack means 14.

Referring to FIG. 4, platforms 17 are seen comprising an elongated member adapted to the telescopingly received within elongated member 11*b* and which is pivotally secured to elongated member 11*b* via trunnions 11*d* guided in an elongated channel means 11*e* extending lengthwise of elongated member 11*b*.

FIG. 4 further discloses platforms 17 in deployed operative position, which position is maintained by jack means 14*a* mounted within elongated member 11*b*. When platforms 17 are to be stowed within elongated member 11*b*, jack means 14*a* is retracted causing platforms 17 to swing round for in-line telescopic retraction, continued retraction of jack means 14*a* pulls platforms 17 within elongated member 11*b* while being guided by trunnions 11*d*. With such arrangement, jack means 14*a* could also be used to extend and retract the telescoping towers comprising elongated member 11*b*. If desired, a locking means may be employed to retain trunnions 11*d* in place relative elongated member 11*b*, when platforms 17 are extended.

Thus, there is a choice of suitable arrangements for connecting platforms 17 or equivalent thereof (which may include a telescopic arrangement also), respective elongated member 11*b* and whereby such platforms may extend from and retract into elongated member 11*b*, details of which are deemed well within the knowledge of those skilled in the art to which the present invention is directed.

Figure 2:
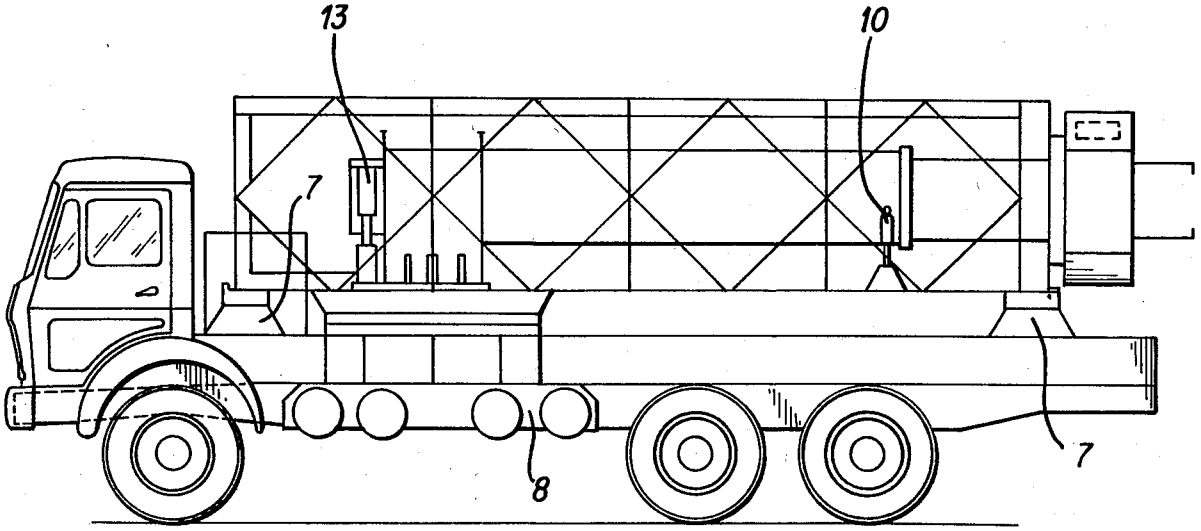
FIG. 2 is an elevational view of the machine seen in FIG. 1*a*, i.e., transport mode showing the extremeties of the machine.

Vehicle 1, as further seen in FIG. 3, includes extendable stabilizer means 8, which as best seen in FIG. 1*b*, comprises a pair of jacks equipped with pads to contact the road. Vehicle 1 may comprise any suitable type including those discussed above and that shown in FIG. 2. Vehicle 1, as further seen, includes supports 7 for use in securing member 11*b*.

As seen in FIG. 1*a*, for example, fifth wheel 11*a*, is so positioned relative vehicle 1, elongated members 11 and 11*b* when in folded position will lie parallel to one another to fit within the periphery of the vehicle.

Attention is directed to FIG. 3 and item 16 representing an oleodynamic engine for use in powering the various components controlled via the control means located in inspection means 18. As indicated previously, the latter control means also controls movement of inspection means 18 which is moved by the aforementioned cylinders (not shown) which are arranged so as to pivot the ladder mounting of inspection means 18 about itself and its connection to platform 17.

A gantry including ladders 19, may be provided as shown in FIG. 3, thus affording easy access to inspection means 18 via platforms 17.

The operation of arrangement 100 will now be briefly described. With vehicle 1 marked in selected suitable position on a structure to be inspected, etc., stabilizing means 8 are extended and put down, as shown, for example in FIGS. 1*b* and 3. Next, elongated member 11 with its telescoped elongated member 12 is rotated upon fifth wheel 11*a* so as to extend broadside of vehicle 1 as shown in FIG. 1*c*, thereafter, elongated member 11*b* is swung via the hinge arrangement 11*c* to extend to the position also shown in FIG. 1*c*, accordingly overhanging the side of the structure to be inspected, etc. The rotation of members 11 and 11*b*, as indicated, may be made manually or by motor means. Next, motor means 13 is activated to rotate elongated member 12 and thus permit elongated member 11*b* and platform 17 therein to depend downwardly as seen in FIG. 1*d*. Next, elongated member 11*b* is extended and platforms 17 extended outwardly therefrom in the manner seen in FIGS. 1*e*, 1*f*, and 3, employing further motor means mentioned. Thereafter, inspection means 18 may be deployed via controlled motor means. With arrangement 100 so displaced, technicians are thus able to ascend and descend ladders 19 and gain access to the underside of the structure supporting vehicle 1 via platforms 17 and inspection means 18. As indicated, some components of arrangement 100 may be of pneumatic type. Compressed air for operation of such may be supplied from a compressor installed on vehicle 1 or from an auxiliary equipment.

I claim:

1. A machine comprising a set of equipment for the control and maintenace of the undersurface of road and railway bridges, also viaducts and their respective piers, i.e. structures comprising an edge which must be traversed in order to gain access to the undersurface thereof, the machine comprising in combination:

(a) a first element comprising a carriage having four or more supports, for example, tyres or steel wheels for railway use, which forms the base for the mounting and extending of components over the edge of the structure that is to be inspected or worked upon, the carriage including stabilizing jacks adapted to extend in a lateral direction from the carriage whereby to be positioned in spaced relation to the carriage and in engagement with the ground or the like supporting the machine, said jacks thus providing suplemental marginal support bearings for use in maintaining the machine substantially horizontal when in operation without the use of counterbalance weights, said stabilizing jacks accommodating the camber of the road and generally absorbing the cantilever loads imposed on the machine during operation, the carriage further including oleodynamic motor means, provided with brake means to permit very small and smooth jerk-free movements of components of the machine during operation thereof;

(b) a second element comprising a first tubular member, rotatably mounted upon said carriage for swingable movement about a generally vertical axis and a second tubular member telescopically mounted within said first tubular member and controlled by jack means for use in changing the directional movement of towers secured thereto and extending therefrom, i.e., from the horizontal to the vertical, thereby controlling a platform comprising one of said towers, said jack means permitting technicians on said platform to not suffer, for example, from the camber of the road, and whereby during said change of directional movement of said towers from the horizontal to the vertical, i.e. non-operative to operative position, they do not extend upwardly of said first and second elements to interfere with electrical wiring or other objects which may be in the vicinity above the machine, said stabilizing jacks operatively engaging said second element to support the same at a point spaced outwardly of the carriage; and (c) a third element comprising said towers and related platform and wherein one of said towers telescopingly engages the other and moved relatively one another by an elongated jack means, said towers being supported upon a fifth wheel mounted on said second tubular member permitting rotation of said platform during the inspection operation, one of said towers further including said platform which is adapted to slide horizontally thereon when in operative position, the sliding movement being effected via means moved by oleodynamic motor means, said platform further including controls for use in controlling operation of the elements comprising the machine.

2. A machine as defined in claim 1, wherein a ladder mounted inspection shuttle adapted to accommodate one or two persons is mounted to said platform and controlled thereby via oleodynamic or compressed air motor means, such providing precision movement and control of the shuttle.

3. A machine as defined in claim 1, wherein said tower not having said platform comprises a pair of members telescopingly engaging one another.

4. An arrangement for use in the inspecting and carrying out of maintenance on, for example, the undersurface of bridges and viaducts, including piers thereof, said arrangement being adapted for mounting upon a mobile frame, said arrangement comprising in combination;

(a) a first elongated member adapted to be rotatably mounted for swingable movement about a generally vertical axis upon said mobile frame;

(b) a second elongated member secured to said first member and adapted to telescopingly extend therefrom and axially rotate relative thereto;

(c) motor means for use in axially rotating and telescopingly moving said second member relative to said first member;

(d) a third elongated member hingedly secured to said second elongated member adjacent the free end thereof;

(e) motor means for use in hingedly rotating said third member relative to said second member;

(f) fifth wheel means associated with said third elongated member for use in rotating said third elongated member relative to said second elongated member;

(g) motor means for use in rotating said third member on said fifth wheel means relative to said second member;

(h) a fourth elongated member telescopingly and pivotally secured to said third elongated member respectively to be extendable therefrom and retractable thereinto so as to lie in spaced parallel relation to said first and second elongated members;

(i) motor means for use in telescopingly moving said fourth elongated member relative to said third elongated member;

(j) motor means for use in pivotally moving said fourth member relative to said third member;

(k) movable platform inspection means on said fourth elongated member and adapted to move relatively thereto and control means on said inspection means for controlling the movement of at least said inspection means relative to said mobile frame; and (l) stabilizing means adapted to be secured to said mobile frame whereby it is extendable laterally therefrom for use in engaging and supporting, in cooperation with the ground or the like supporting said mobile frame said first elongated member at a point in spaced relation to said mobile frame, whereby to substantially absorb the cantilever loads imposed on said mobile frame during operation of the arrangement.

5. An arrangement as defined in claim 4, wherein said adaptation for rotation on said mobile frame comprises a fifth wheel means.

6. An arrangement as defined in claim 4, wherein said third member comprises first and second tower members, one of which is telescoped within the other.

7. An arrangement as defined in claim 4, wherein said inspection means is ladder mounted upon said fourth elongated member.

8. An arrangement as defined in claim 4, wherein said inspection means comprises a small platform for accommodating one or two persons.

9. An arrangement as defined in claim 4 wherein said movable platform inspection means comprises a platform slidably arranged on said fourth member and which together with said fourth member is arranged to be extendable from and retractable into said third member.

10. An arrangement as defined in claim 9, wherein the sliding movement of said platform is effected via oleodynamic motor means.

11. An arrangement as defined in claim 4, including said mobile frame.

12. An arrangement as defined in claim 11, wherein said mobile frame comprises a truck vehicle with pneumatic tyres.

13. An arrangement as defined in claim 12, wherein said rotatable mounting of said first elongated member is so positioned respective said vehicle, said first and second elongated members when in stowed non-operative position will extend longitudinally of the vehicle and said hinging permits said third elongated member comprising said fourth elongated member, to extend longitudinally of the vehicle in spaced parallel relation to said first and second elongated members.

14. An arrangement as defined in claim 4, wherein said fourth elongated member is secured to said third elongated member via trunnion means which is guided in channel means on said third elongated member.

15. An arrangement as defined in claim 14, wherein said fourth elongated member is pivoted on said trunnion means by extendable jack means secured to said third and fourth elongated members.

16. An arrangement as defined in claim 15, wherein said third member comprises first and second tower members, one of which is telescoped within the other and said extendable jack means is arranged also to telescopingly extend said tower members.

17. A machine comprising a set of equipment for use in the inspection and maintenance of the undersurface of bridges and viaducts and their respective piers, the machine comprising: a wheeled carriage which forms the base of the mounting of the equipment which is adapted to be launched from the carriage over the edge of the bridge-viaduct structure, the equipment including a first elongated boom member rotatably mounted for swinging movement about a generally vertical axis upon the carriage, the equipment also including a second elongated boom member secured to said first elongated boom member and adapted to telescopingly extend therefrom and axially rotate relative thereto, including motor means for use in telescopingly moving and axially rotating said second member relative to said first member, to change the directional movement of towers secured to said second elongated boom member, from the horizontal to the vertical, when said first and second elongated boom members are launched laterally from the carriage in operative position, and wherein during said change of directional movement, the towers do not extend upwardly of said first and second elongated boom members, the carriage including means for stabilizing the carriage when the equipment is extended, said means for stabilizing comprising stabilizing jack means securable in spaced relation to said carriage laterally thereof and engaging the support for the machine and engaging said launched first elongated boom member whereby to support the same, thus to prevent the carriage being subjected to cantilever loads imposed as a result of said launched equipment and eliminate the need for counterbalance weights on the carriage, said machine including oleodynamic motor means equipped with braking means to provide smooth and jerk-free movements of the equipment during operation thereof.

* * * * *